US006351621B1

(12) United States Patent
Richards et al.

(10) Patent No.: US 6,351,621 B1
(45) Date of Patent: Feb. 26, 2002

(54) WIRELESS INTERACTION WITH MEMORY ASSOCIATED WITH A REPLACEABLE MODULE FOR OFFICE EQUIPMENT

(75) Inventors: Austin L. Richards; Michael B. Thomson, both of Hertfordshire (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/603,232

(22) Filed: Jun. 26, 2000

(51) Int. Cl.[7] ..... G03G 21/16; G03G 15/00
(52) U.S. Cl. ..... 399/111; 399/12; 399/25
(58) Field of Search ..... 399/8, 12, 24, 399/25, 27, 109, 110, 111, 116, 119, 122, 262; 347/19

(56) References Cited

U.S. PATENT DOCUMENTS 4,961,088 A * 10/1990 Gilliland et al. ..... 399/25
5,289,242 A * 2/1994 Christensen et al. ..... 399/12
5,675,534 A * 10/1997 Hewitt et al.
6,181,885 B1 * 1/2001 Best et al. ..... 399/12
6,227,643 B1 * 5/2001 Purcell et al. ..... 347/19
6,233,409 B1 * 5/2001 Haines et al. ..... 399/8 X

FOREIGN PATENT DOCUMENTS

JP 11-338329 * 12/1999

* cited by examiner

*Primary Examiner*—Sandra Brase
(74) *Attorney, Agent, or Firm*—R. Hutter

(57) ABSTRACT

In a printer or copier, a removable module, such as a marking material supply module or a marking device module, is provided with a non-volatile memory chip which retains information about the cumulative use of the module and other performance-related data. The non-volatile memory is accessed through a wireless interface, such as an RF loop or IR detector, which is also associated with the module. The memory can be accessed, through wireless means, either by the printer or copier itself or by an external device. The wireless interface can also be used to access a memory which is attached to part which moves within the printer or copier, such as a roller or drum, thus avoiding the use of wire harnesses.

10 Claims, 4 Drawing Sheets

WIRELESS INTERACTION WITH MEMORY ASSOCIATED WITH A REPLACEABLE MODULE FOR OFFICE EQUIPMENT

CROSS REFERENCE TO RELATED APPLICATION

Cross reference is hereby made to "Infrared Communication Among Control Boards in a Printing Apparatus," U.S. application Ser. No. 09/603,860, assigned to the assignee hereof and being filed simultaneously herewith.

INCORPORATION BY REFERENCE

U.S. Pat. No. 5,675,534 is hereby incorporated by reference for all teachings therein relating to code hopping encryption in a wireless communication context.

FIELD OF THE INVENTION

The present invention relates to wireless communication with control circuitry and memory which is associated with replaceable modules, as would be installable in office equipment such as printers and copiers.

BACKGROUND OF THE INVENTION

A common trend in the maintenance of office equipment, particularly copiers and printers, is to organize the machine on a modular basis, wherein certain distinct subsystems of a machine are bundled together into modules which can be readily removed from machines and replaced with new modules of the same type. A modular design facilitates a great flexibility in the business relationship with the customer. By providing subsystems in discrete modules, visits from a service representative can be made very short, since all the representative has to do is remove and replace a defective module. Actual repair of the module takes place away at the service provider's premises. Further, some customers may wish to have the ability to buy modules "off the shelf," such as from an office supply store. Indeed, it is possible that a customer may lease the machine and wish to buy a succession of modules as needed. Further, the use of modules, particularly for supply units such as toner bottles, are conducive to recycling activities which are available, and occasionally mandatory, in many countries.

In order to facilitate a variety of business arrangements among manufacturers, service providers, and customers of office equipment such as copiers and printers, it is known to provide these modules with electronically-readable chips which, when the module is installed in a machine, interface with the machine in some way so as to enable the machine to both read information from the memory and also write information, such as a print count, to the module.

DESCRIPTION OF THE PRIOR ART

U.S. Pat. No. 4,586,147 discloses an electrophotographic printing apparatus having a "history information providing device." The device includes a non-volatile memory for taking out the latest failure information, such as the number of paper jams, and the latest maintenance information such as the total number of pages of printed paper and storing this information therein. The information thus stored in the non-volatile memory is accessed by causing the printer to print out the information stored in the non-volatile memory.

U.S. Pat. No. 4,774,544 discloses an electrophotographic printer in which the number of image forming operations is maintained in an EEPROM within the machine. The EEPROM is used to hold the data in case the machine is turned off.

U.S. Pat. No. 4,961,088 discloses the basic concept of using an electronically-readable memory permanently associated with a replaceable module which can be installed in a digital printer. The embodiment disclosed in this patent enables a printer to check an identification number of the module, to make sure the module is authorized to be installed in the machine, and also enables a count of prints made with the module to be retained in the memory associated with the module.

U.S. Pat. No. 5,049,898 discloses an ink-jet printhead cartridge having a memory element associated therewith. This memory element can store operational characteristics, such as a code indicating the color of ink in the printhead, or the position of the ink-jet orifices on the printhead body. A datum characterizing the amount of ink in the cartridge at any time can be periodically updated to reflect use of ink during printing and can warn the user of an impending exhaustion of ink.

U.S. Pat. No. 5,283,613 discloses a substantially "tamper proof" electronically-readable memory for use in a replaceable print module. A count memory associated with a replaceable module maintains a one-by-one count of prints made with the module. The memory associated with the module further includes a memory which can only be decremented, which serves as a "check" to prevent electronic manipulation of the print count memory.

U.S. Pat. No. 5,289,210 discloses an ink-jet printing apparatus wherein the printhead is equipped with a non-volatile memory which contains data representing recording characteristics of the head, and data which enables identification of whether the printhead matches the apparatus. At power-up, the printing apparatus reads the data from the printhead and identifies whether a matching printhead has been installed.

U.S. Pat. No. 5,675,534 discloses an embodiment of code hopping encryption used in wireless communication, it such as to operate garage doors or automobile locks. Related to this patent is a product, commercially available as of the filing hereof, called the HCS320 KEELOQ™ code hopping encoder, made by Microchip Technology Inc.

U.S. Pat. No. 5,914,667 discloses a relatively sophisticated code hopping encryption system for use in wireless communication.

SUMMARY OF THE INVENTION

According to one aspect of the present invention, there is provided a module installable in a printing apparatus, comprising hardware related to printing, a memory permanently associated with the module, and a wireless interface for operating the memory.

According to another aspect of the present invention, there is provided a method of operating a module usable within a printing apparatus, the module including hardware related to printing, a memory, and a wireless interface. A wireless signal is emitted to the wireless interface. The wireless interface operates the memory in response to receiving the wireless signal.

According to another aspect of the present invention, there is provided a printing apparatus, comprising a part which moves within the printing apparatus while the printing apparatus is operating and a module rigidly attached to the part. The module includes a wireless interface for operating the module in response to receiving a wireless signal.

DETAILED DESCRIPTION OF THE INVENTION

Figure 1:
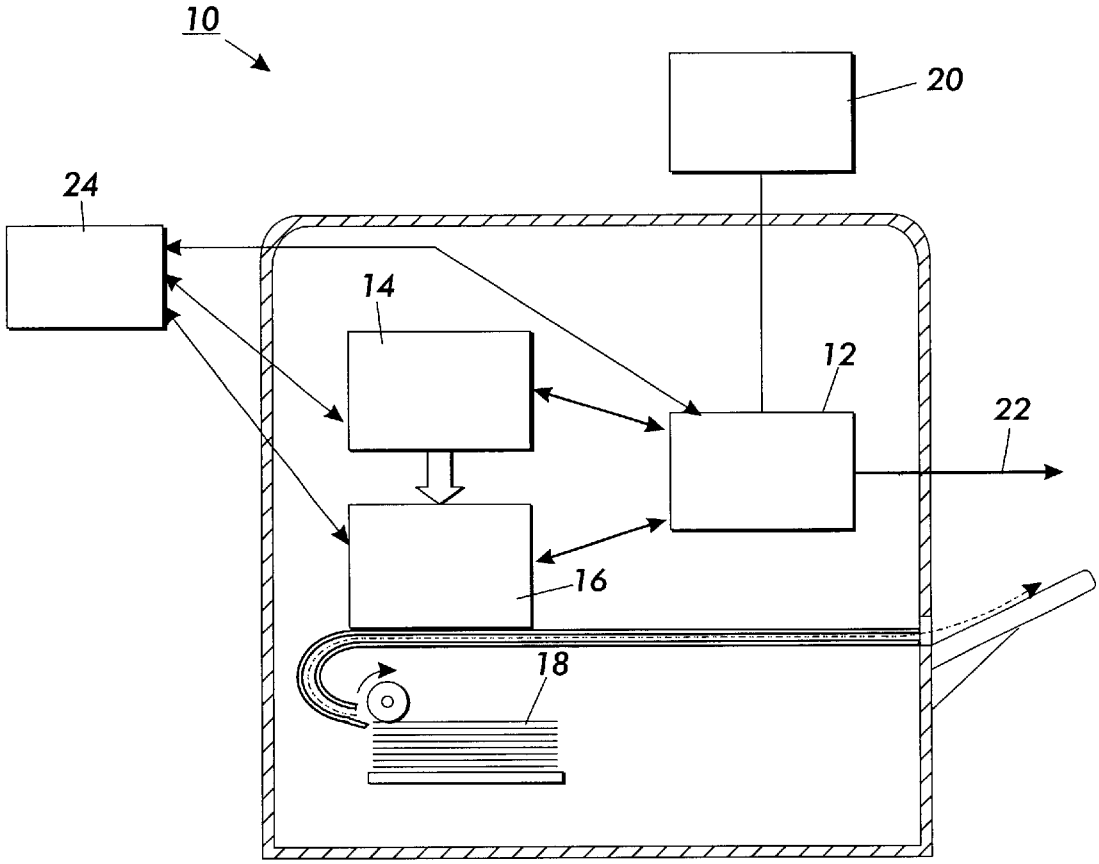
FIG. 1 is a simplified elevational view showing the placement of replaceable modules, such as a marking material supply module and a marking device module, within office equipment such as a digital printer.

FIG. 1 is an elevational view showing in the essential elements of a piece of office equipment, such as a digital printer of the ink jet or "laser" (electrophotographic or xerographic) variety, or a digital or analog copier, incorporating the present invention. The office equipment, which will herein be referred to generally as printer 10, includes a central control board 12, as well as what are here called a marking material supply module 14 and a marking device module 16: broadly, such modules include what can be called "hardware related to printing." Sheets on which images to be printed are drawn from a stack 18 and move relative to the marking device module 16, where the individual sheets are printed upon with desired images. The marking material for placing marks on various sheets by marking device module 16 a is provided by marking material supply module 14. Typically, if printer 10 is of the xerographic variety, marking material module 14 includes a supply of toner, while marking device module 16 includes any number of hardware items for the xerographic process, such as including a photoreceptor or fusing device. In the ink-jet context, the marking material module 14 includes a quantity of liquid ink, and may include a separate tanks for different primary-colored inks, while marking device module 16 includes a printhead. Of course, depending on a particular design of a printer 10, the functions of modules 14, 16 may be combined in a single module, or alternately, the marking device may not be provided in a easily replaceable module such as 16. Further, there may be provided several different marking material modules 14, such as in a full color printer. What is important, for purposes of the present invention, is that there simply be provided one or more replaceable modules associated with the printer 10, and it is expected that, at multiple times within the life of printer 10, one or more of these modules such as 14 or 16 need to be replaced. In the current market for office equipment, is typically desirable that such modules such as 14 or 16 be readily replaceable by the end user, thus saving the expense of having a representative of the vendor visit the user.

It will be seen in FIG. 1 that the various modules such as 14 or 16, as well as control board 12, which generally oversees the operation of the entire printer 10, communicate among each other for purposes of outputting prints. The lines of communication among various modules is shown simply as a double-headed arrows, and will be described in detail below. Control board 12 may further include a connection to a user interface 20 through which certain messages regarding the function of the printer 10 are communicated to the user. Control module 12 may also communicate with users through a network connection 22, such as over phone lines or the Internet.

In the office equipment industry, the concept of the "customer replaceable unit monitor," or CRUM, is well known. A CRUM is generally an electronic device which is permanently associated with a replaceable module which may be installed in a printer or copier. Typically, the CRUM includes a non-volatile memory, such as in the form of an EEPROM, which retains data relevant to the function and performance of the module, whether that module is a marking material supply module 14 or a marking device module 16. Because it includes a non-volatile memory, the CRUM can act as a "scratch pad" for retaining data which travels with the replaceable module, even after the replaceable module is removed from a particular machine.

There are many different types of data at which could be stored in a CRUM which is associated with a particular module. In a broad sense, the CRUM could retain a serial number of the particular module, and identification of the module by the serial number can be used by the machine in which the module is installed to determine, for example, whether the particular installed module is compatible with the machine. In other types of CRUM systems, the CRUM can further act as an "odometer" to maintain a cumulative count of all the prints which have been output using the particular module. In many contexts, a system will use the print count in the CRUM to permit a certain predetermined number of prints to be a output with the particular module, and then block further use of the module. In more sophisticated versions of the odometer concept, there may be provided within a single CRUM provision for maintaining multiple print counts: for instance, in addition to counting the number of prints which have been made by a particular module since the module was built, the second print count may be maintained a of how many prints were made with the module since the module was last remanufactured (refilled or repaired). In another example, a second count may serve as a check on the first count, such as in a system whereby a first print count must be somehow mathematically consistent with the second count, so that any person trying to tamper with the print count will have to know to make the second count consistent with the first count. Also, in particular with marking material supply modules, different independent print counts may be associated with the different supplies of color marking materials. (Under the rubric of "marking material" in the claims herein can be other consumed items used in printing but not precisely used for marking, such as oil or cleaning web used in a fusing device.)

Another type of data which may be stored in a particular location in the non-volatile memory of the CRUM may relate to specific performance data associated with the module, so that the module can be operated in an optimal, or at least advisable, manner. For instance, in the ink jet context, it is known to load data symbolic of optimal voltage or pulse width in the CRUM, so that the particular module may be optimally operated when the module is installed. In the xerographic context, it is known to load into a CRUM module specific data such as relating to the tested transfer efficiency of toner from a photoreceptor to a print sheet: this information is useful for an accurate calculation of toner consumption. Again, there may be provided any number of spaces in the of the CRUM memory for retaining information relating to different performance data.

Other types of data which may be profitably included in the non-volatile memory in a CRUM include one or more serial numbers of machines, such as printers, in which the particular module is or has been installed: this may be useful for tracing faults in the module or among a population of machines. Also, if the particular module is intended to be remanufactured, another useful piece of data to be loaded into the memory can be the date of the last remanufacture of the module, as well as a code relating to some detail of the remanufacture, which may be symbolic of, for instance, a location of the remanufacture, or the specific actions that were taken on the module in a remanufacturing process.

With particular reference to the present invention, the individual CRUMs which are associated with one or more individual replaceable modules within a printing apparatus can be accessed and operated by wireless means, such as by infrared or RF, or even ultrasound, communication. According to the specification and claims herein, the word "operating" can encompass many different functions. For example, wireless means may be used to activate the CRUM to cause the CRUM to "answer" with some or all of the data which is in its non-volatile memory at any given time. More basically, the wireless means can be used simply to unlock or permit access to data in the memory in response to an external wireless signal of a predetermined type, the data itself being transferred by a hard-wire interface. Alternately, wireless means can be used to write data into the non-volatile memory of the CRUM, such as to reset a print count in the CRUM, for example. This wireless interaction with, and operation of, a CRUM associated with a module can occur regardless of the particular location of the module at any given time: the operation can occur, for instance, while a module is installed within a printer 10, during a remanufacturing process, or while the module is packaged and stored in a warehouse.

With regard to FIG. 1, the various double headed arrows among the boards and modules 12, 14, 16, indicate paths through which the CRUMs or other boards can interact with each other through wireless means. For instance, the main control board 12 can interact by wireless means with CRUMs associated with marking supply module 14 or marking device module 16. Alternately, a device external to the printer 10, such as indicated as device 24, can use wireless means to interact either with the control board 12, or, alternately, directly interact with the CRUMs associated with module 14 or 16, bypassing the control system of printer 10 completely.

Figure 2:
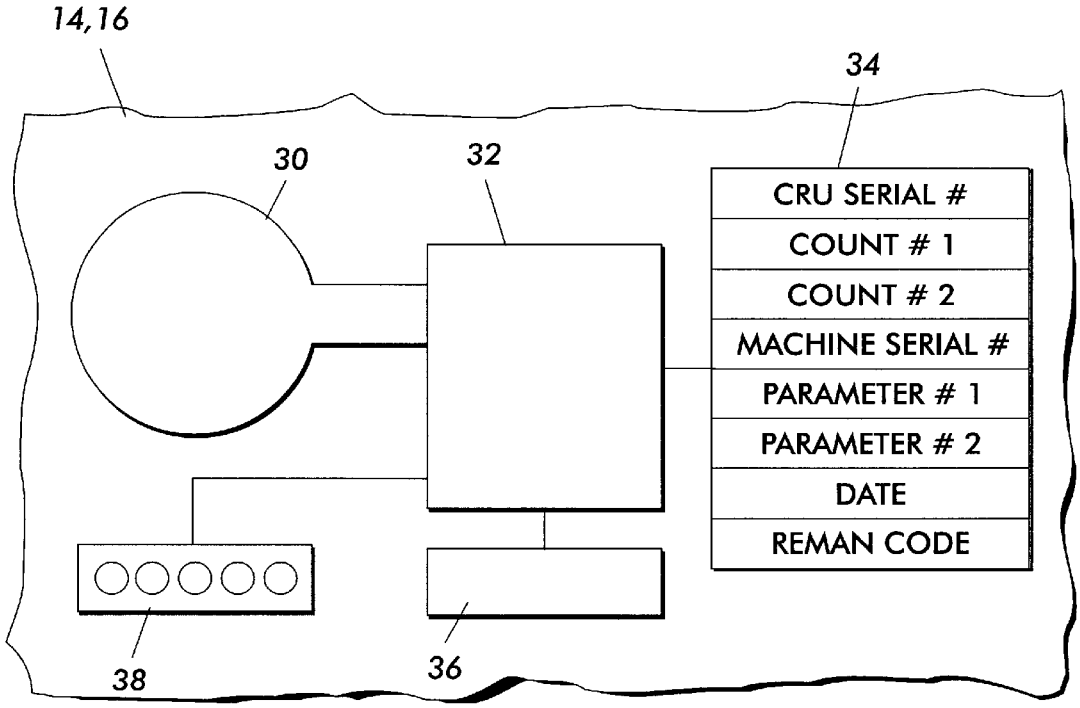
FIG. 2 is a simplified view showing the essential elements of a wireless monitoring and control device associated with a replaceable module such as shown in FIG. 1, according to the present invention.

FIG. 2 is a simplified view showing the essential elements of a CRUM which is operable through wireless means, according to the present invention. The CRUM is preferably permanently attached to a surface either on the outside or the inside of a particular module, such as a marking material supply module 14 or marking device module 16; a portion of such a surface is shown in FIG. 2. In order to operate through wireless means, a CRUM requires some sort of wireless interface, such as the RF loop indicated as 30 in FIG. 2 (along with, of course, associated circuitry, the nature of which would be apparent to one of skill in the art), although other wireless interfaces, such as an infrared detector, ultrasound detector, or some other optical coupling, could be provided.

In the particular illustrated embodiment, the RF loop 30, which is sensitive to RF signals of a predetermined frequency, is associated with a chip 32. According to a preferred embodiment of the invention, this chip 32 includes circuitry which acts as an interface between the RF loop 30 and non-volatile memory 34. (Of course, in a practical embodiment, the non-volatile memory 34 could be disposed within the chip 32, but is here shown separately for purposes of clarity. In one possible embodiment, the loop 30 can be formed as an etched loop aerial as part of the circuit board forming the CRUM. Chip 32 may also have associated therewith a power supply 36, the exact nature of which will depend on a specific design.) In order to act as such an interface, chip 32 includes circuitry for recognizing and processing wireless signals of a particular type which may be detected on loop 30. The chip 32 may further be provided with a "hard wire" interface 38, which could be adapted to interact with circuitry within the printer 10.

As can be seen in FIG. 2, the non-volatile memory 34 includes predetermined locations therein for a module serial number, print counts (for the cumulative use of the module and/or a maximum allowed number of prints to be made with the module), remanufacturing date and code, as needed, such as according to the descriptions of CRUM functions noted above.

Depending on a particular embodiment of the present invention, the wireless operation of a CRUM associated with the module such as 14 or 16 can work in different ways. In one possible embodiment, the detection of a suitable wireless signal on loop 30 by chip 32 causes the chip 32 to read out all data relating to the CRUM which are stored in non-volatile memory a 34 at any given time. This data from memory 34 can either be broadcast back through loops 30 by wireless means (if such a transmission means is provided, such as within chip 32) or alternately, can be read out through hard wire interface 38 to, for example, control board 12. In turn, this information can be a sent from a control board 12 to user interface 20 and/or sent to a computer over line 22, such as shown in FIG. 1.

Another type of wireless operation of a CRUM is to have an initially detected wireless signal cause chip 32 to make memory 34 to enter a "write mode." In other words, the initial wireless contact, such as a wireless signal of a predetermined type, which activates the chip 32 while causing the chip 32 to expect another wireless data stream through loop 30 within a predetermined time frame. This incoming wireless data can then be used to populate specific locations in the memory 34, such as to reset different performance data parameters within the memory. Most specifically, an initial wireless signal could be used to reset the various print counts in the memory to go back to zero or to some other predetermined number. This function would be useful for a remanufacturing process in which the remanufactured module can once again be used to output a predetermined number of prints. Alternately, wireless means can be used to change or otherwise update other performance data in the memory 34, such as changing parameters for optimal pulse width or transfer efficiency, in view of testing on the module which was performed as part of the remanufacturing process. Finally, there could also be entered into memory 34 data relating to the date of remanufacture, as well as a special codes relating to what type of actions were taken on the module in the remanufacture in process, for instance, whether or not a photoreceptor drum was replaced or whether a particular ink tank was refilled.

If wireless means are used to change data in memory 34, it may be desirable to recognize that certain data within the memory 34 associated with a particular model should never be changed. For instance, it may be important that the serial number or master print count of the module never be changed, the matter how often the module is remanufactured. Alternately, if some specific remanufacturing actions are taken on a module, it may be necessary to change only one of the parameters in memory while leaving the various print counts intact. In such cases, it may be desirable to provide a system in which a special "leave unchanged" code is read into a particular location in memory 34, this special code being interpreted by chip 32 as an instruction to leave whenever data is in that particular location in memory 34 unchanged.

Depending on certain considerations, such as cost, or the fact that a CRUM system is being retrofit into an existing model of printer, certain data can go in or out of the CRUM through loop 30 or alternately through hard wire interface 38. For example, the wireless operation of the various CRUMs may be on a very simple level, such that the detection of a suitable wireless signal on 30 can simply "unlock" the non-volatile memory 34 for writing therein, although the actual writing to memory 34 may take place through hard wire interface 38.

In terms of enabling the present invention, basic principles of wireless controls of electromechanical and electronic devices, such as garage doors and televisions, are well known. The general principles of operating a CRUM are readily adapted from these arts in view of the present specification.

As described in the patent incorporated by reference above, it is generally known in the art to provide certain sophisticated security devices, such as involving code hopping encryption, to prevent on authorized wireless access to the CRUM. As shown in FIG. 2, the chip 32 may have provided therein an encryption key which will have the effect of permitting only those users having the encryption key to access the CRUM by wireless means. This feature is very useful for preventing unauthorized tampering with data in memory 34, such as to alter the print counts. While the use of systems such as code hopping encryption are known in the "security" context of locking automobiles and a garage door openers, it is believed to be novel to use this system in the context of preventing access to memory associated with a replaceable modules in office equipment.

Figure 3:
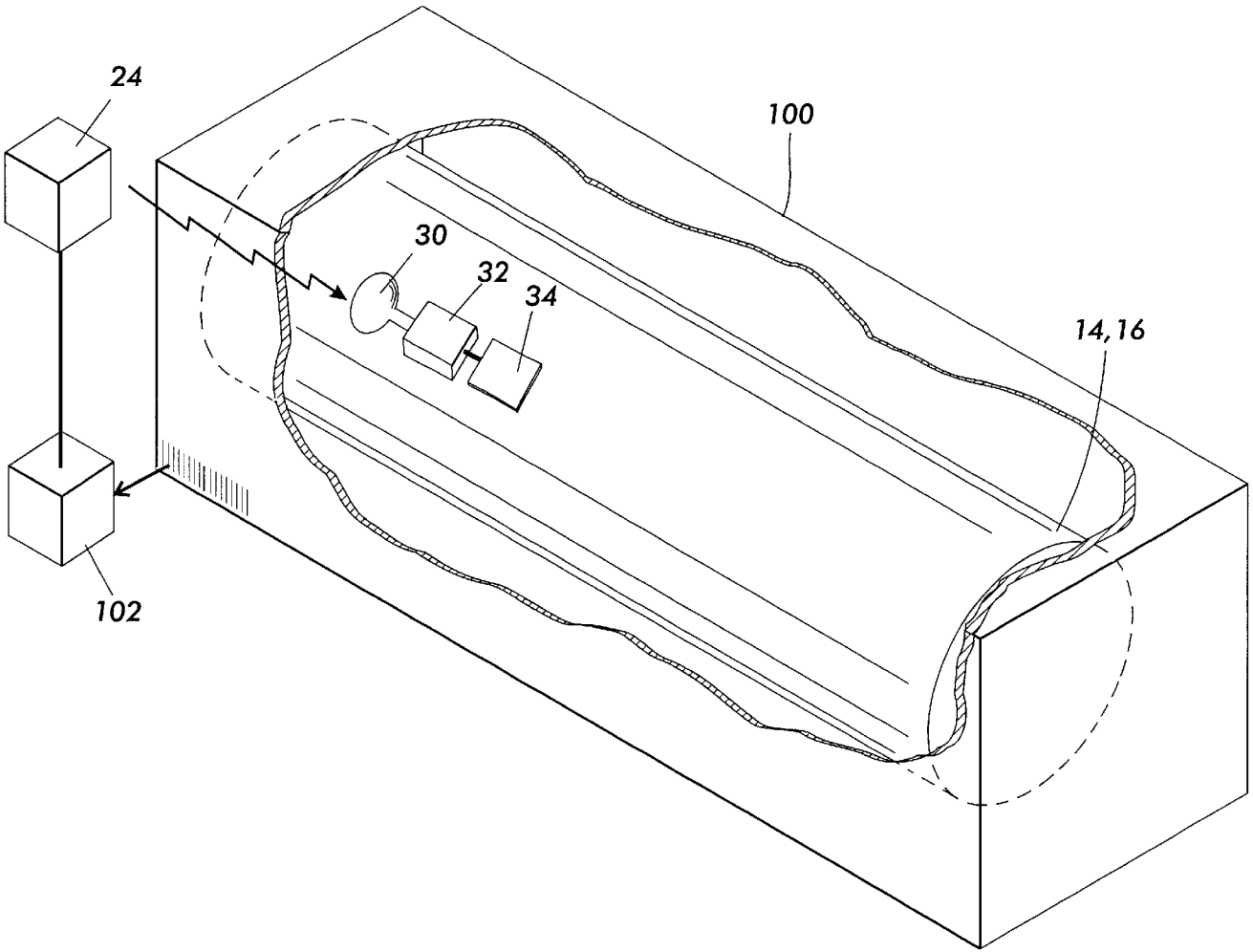
FIG. 3 is a simplified view showing a replaceable module according to the present invention, disposed within a package, and being processed within a system according to another aspect of the present invention.

In addition to facilitating the reading and writing of data from a memory associated with the CRUM, the present invention facilitates new techniques in both remanufacturing and distributing replaceable modules such as marking material module 14 and marking device module 16. One key advantage of wireless communication with a CRUM, particularly Infrared or RF communication, is that in the wireless signals can pass through many types of packaging, and thus CRUMs can be operated even while the module to which they are associated is packaged. FIG. 3 is a simplified view showing how a module such as 14 or 16 disposed within a signal-transmissive (for instance, cardboard) package 100 can be accessed and operated by wireless means. A device 24, which emits the suitable RF or infrared radiation, can be used to write relevant data into memory 34 of the CRUM. Such data may be of a time sensitive variety, such as the date a particular package module is mailed to an end user: in such a case, it may be desirable to have the module itself prepackaged and write the date of mailing to memory 34 just as the package 100 is going out the door. Similarly, special codes can be read into memory 34 representing, for example, the identity of the end user intended to receive the module in the mail, or a particular service contract number under which the packaged module is sent. Because of the wireless nature of writing into memory 34, a supply of modules, already in packages 100, can be retained in a warehouse and written into with relevant information only as the are sent to end users.

Another possibility is to package different modules 14, 16, and have a bar code reader, such as 102, or equivalent device, read markings on the package 100, and then cause a device 24 to write data relating to the bar code data into memory 34 by wireless means. For example, the bar code reader 102 could read a bar code on the outer surface of package 100 representative of the addressee of the package, and cause device 24 to write a code identifying the address into memory 34.

Alternately, as the CRUM is capable of broadcasting back information and memory 34 by wireless means as well, the particular CRUM within package 100 could be queried by wireless means just as it is being sent to a user, and this information recorded, so that a vendor could know exactly which CRUMs, identified by serial number, were sent to what addressee on any particular day. Another possibility is to determine the serial number of a module within a package 100 by wireless means, and then have a bar code writer print a code relating to the serial number on a label to be attached to the package 100.

Another feature enabled by the use of wireless communication would be the use of one transmitter/receiver within the machine being able to communicate with multiple modules used within the machine. This would provide a cost saving, as multiple harnesses for each device would not be needed.

Figure 4:
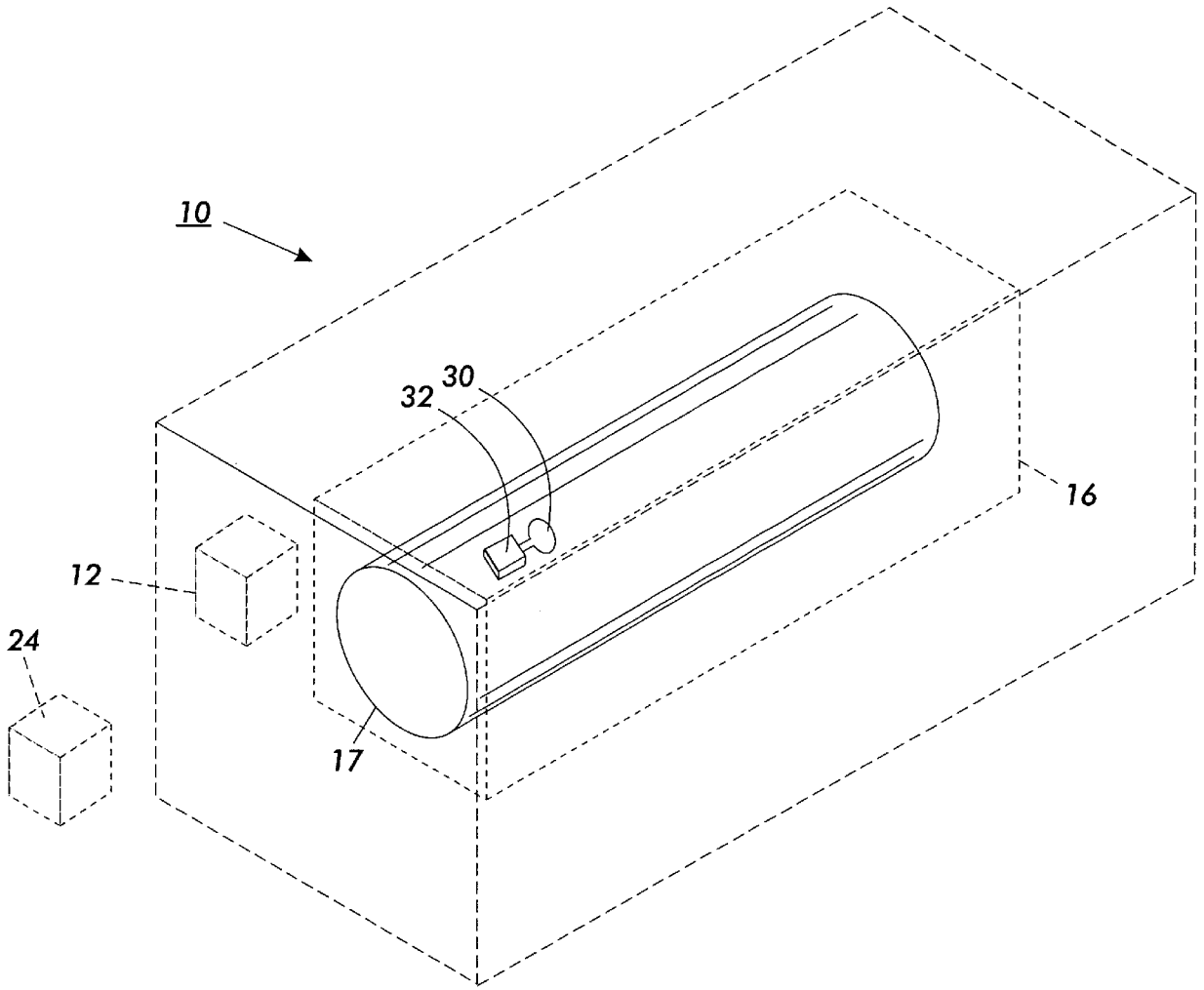
FIG. 4 is a simplified view showing a part within a printing apparatus with a wireless interface attached thereto.

Wireless communication can also facilitate the use of data storage devices on moving parts where harnessing would be problematic. This is useful with rotating parts such as photoreceptors, fuser rolls, or other rollers, translating parts such as trays, and parts where tolerance build up may not support the mating of harnesses. FIG. 4 shows an example of a part within a printing apparatus 10, namely a rotating photoreceptor drum 17, which moves relative to the body of the printing apparatus during normal operation. According to one aspect of the present invention, a wireless interface such as including loop 30 and chip 32 is rigidly attached to the drum (such as on an inner surface thereof), so that a corresponding wireless communication device proximate to the drum, such as in board 12, could interact with the module even as the drum 17 is rotated in normal use. This implementation of the invention can be provided whether or not the moving part in question is intended to be replaced within the machine on a regular basis. A device to emit wireless signals to loop 30 could be disposed within a module such as 16 or generally within machine 10, or even external to the machine, such as shown in the FIG. as 24.

In the various embodiments of the present invention described and claimed herein, a typical effective range of wireless communication for wireless devices can be as little as 10 mm. Electronic components capable of achieving this range are readily available as of the filing hereof, such as the KEELOQ™ series of components available from Microchip Technology Inc.

What is claimed is:

1. A module installable in a printing apparatus, comprising:

hardware related to printing;

a memory permanently associated with the module;

a wireless interface for operating the memory; and a hard wire interface associated with the memory, and wherein the memory is accessible through the hard wire interface.

2. A module installable in a printing apparatus, comprising:

hardware related to printing;

a memory permanently associated with the module;

a wireless interface for operating the memory; and a hard wire interface, the wireless interface causing the memory to be made accessible in response to receiving a wireless signal of a predetermined type, and allowing data in the memory to be altered through the hard wire interface.

3. A method of operating a module usable within a printing apparatus, the module including hardware related to printing, a memory, and a wireless interface, comprising the steps of:

disposing the module within a package, the module to be removed from the package when the module is used within a printing apparatus;

emitting a wireless signal to the wireless interface when the module is disposed within the package; and the wireless interface operating the memory in response to receiving the wireless signal.

4. The method of claim 3, the operating step including unlocking data in the memory.

5. The method of claim 3, the operating step including causing data from the memory to be emitted by wireless means from the module.

6. The method of claim 3, the operating step including causing the memory to enter a write mode.

7. The method of claim 6, further including the step of permitting data to be written into the memory through wireless means.

8. The method of claim 3, further comprising the steps of reading information on the package and emitting a signal related to the information to the module.

9. A method of operating a module usable within a printing apparatus, the module including hardware related to printing, a memory, and a wireless interface, comprising the steps of:

emitting a wireless signal to the wireless interface; and the wireless interface operating the memory in response to receiving the wireless signal, the operating s step including making data in the memory accessible through a hard wire interface.

10. A method of operating a module usable within a printing apparatus, the module including hardware related to printing, a memory, and a wireless interface, comprising the steps of:

emitting a wireless signal to the wireless interface; and the wireless interface operating the memory in response to receiving the wireless signal, thereby permitting data to be written into the memory through a hard wire interface.

* * * * *